US008141677B2

(12) United States Patent
Goller

(10) Patent No.: US 8,141,677 B2
(45) Date of Patent: Mar. 27, 2012

(54) RING SHAPED MEMBRANE FOR AN ELECTRO-ACOUSTICAL LOUDSPEAKER

(75) Inventor: Lars Goller, Herning (DK)

(73) Assignees: C.V. Sinar Baja Electric, Surabaya (ID); Danesian Audio APS, Herning (DK)

( * ) Notice: Subject to any disclaimer, the term of this patent is extended or adjusted under 35 U.S.C. 154(b) by 0 days.

(21) Appl. No.: 12/670,201

(22) PCT Filed: Jul. 25, 2008

(86) PCT No.: PCT/DK2008/000278

§ 371 (c)(1),
(2), (4) Date: Jan. 22, 2010

(87) PCT Pub. No.: WO2009/012781

PCT Pub. Date: Jan. 29, 2009

(65) Prior Publication Data

US 2011/0155502 A1 Jun. 30, 2011

(30) Foreign Application Priority Data

Jul. 25, 2007 (DK) ..... 200701091
Dec. 4, 2007 (DK) ..... 200701737

(51) Int. Cl.
*G10K 13/00* (2006.01)

(52) U.S. Cl. ..... 181/173; 181/167; 381/337; 381/340

(58) Field of Classification Search ..... 181/173, 181/167; 381/337, 430
See application file for complete search history.

(56) References Cited

U.S. PATENT DOCUMENTS

| | | | | | |
|---|---|---|---|---|---|
| 3,221,834 | A * | 12/1965 | Noren et al. | ..... | 181/164 |
| 3,285,364 | A * | 11/1966 | Cohen | ..... | 181/166 |
| 3,665,124 | A * | 5/1972 | Sotome | ..... | 381/401 |
| 3,768,590 | A * | 10/1973 | Yocum | ..... | 181/167 |
| 3,955,055 | A * | 5/1976 | Kawakami et al. | ..... | 381/430 |
| 4,146,756 | A * | 3/1979 | Kito et al. | ..... | 381/426 |
| 5,056,617 | A * | 10/1991 | Wank et al. | ..... | 181/173 |
| 5,418,337 | A * | 5/1995 | Schreiber | ..... | 181/171 |
| 5,740,264 | A * | 4/1998 | Kojima | ..... | 381/423 |
| 6,320,972 | B1 * | 11/2001 | Goller | ..... | 381/430 |
| 2002/0139609 | A1 * | 10/2002 | D'Hoogh | ..... | 181/167 |
| 2009/0060251 | A1 * | 3/2009 | Maeda | ..... | 381/398 |

* cited by examiner

*Primary Examiner* — Forrest M Phillips
(74) *Attorney, Agent, or Firm* — Daniels Patent Law PLLC; Scott A. Daniels

(57) ABSTRACT

Ring-shaped membrane for an electro-acoustical loudspeaker, where said membrane comprises two or more dome-shaped annulus concentrically arranged around a central portion through which an imaginary axis of symmetry passes, where an outer periphery of said membrane is suitable to be attached to a surround; where the central portion is attached to a tower, which again is fastened to the loudspeakers driver, wherein the angle between a plane being perpendicular to the axis of symmetry and the attachment of the membrane to the surround resp. the tower is in the interval 0° to 40°, most preferred around 30°.

16 Claims, 1 Drawing Sheet

RING SHAPED MEMBRANE FOR AN ELECTRO-ACOUSTICAL LOUDSPEAKER

FIELD OF THE INVENTION

The present invention relates to a ring shaped membrane for an electro-acoustical loudspeaker.

BACKGROUND OF THE INVENTION

Electro-acoustical loudspeakers are widely used and traditionally comprise a chassis in which a driver and a membrane are arranged. The driver is typically a magnetic system defining an air gap, in which air gap the magnets have been arranged such that a magnetic flux will be present across the gap. By having a voice coil connected to the membrane and arranging set voice coil in the air gap and furthermore connecting the coil to an amplifier, the current in the coil will be influenced by the magnetic field in the gap and thereby move up and down depending on the direction of the current in the coil.

The voice coil is traditionally connected to the membrane such that, as the voice coil moves back and forth in the air gap, the membrane will move accordingly and thereby create the sound.

From JP 2006041783 is a speaker system known comprising a membrane consisting of two dome shaped annulus arranged coaxially. The coil is attached to the connection between the inner and outer annulus and arranged in an air gap in the driver motor. The centre portion of the inner annulus is fastened to an upper portion of the loudspeaker driver motor. As the coil moves up and down in the airgap, sound will emit from the surface of the membrane. The emission direction will be substantially perpendicular to the surface of the membrane, in each point on the membrane. In action the inner annulus will thereby emit sound (waves) towards the center from the portions of the membrane being angled towards the central portion of the membrane. These sound waves will instantly interfere with sound waves deriving from the same membrane part diametrically opposite on the membrane. This interference will cause a certain degree of distortion in the resulting "sound picture".

OBJECT OF THE INVENTION

A number of suggestions in the art of how to make membranes with improved characteristics are suggested and among these are also a number of ring shaped membranes having two or more dome-shaped annulus arranged concentrically around a central portion, see discussion above. These particular embodiments are designed in order to provide the possibility for higher sound pressure, better distribution meaning more even and more realistic sound distribution utilizing a larger membrane surface area within a smaller space. In a number of these prior art constructions, they have been provided with a sound plug centrally in the membrane in order to fasten the membrane to the chassis centrally. Furthermore, the design of the plug has been carried out in a number of different manners in order to avoid disturbances and/or interference in the response of the membrane and the sound emitted by the membrane. It is however a drawback of these constructions that the plug in the centre takes away part of the effective membrane area and thereby, part of the ability of the loudspeaker construction to emit sound. Membranes using plugs, become less sensible whereby, an altogether relatively larger membrane area is needed in order to reproduce the sound satisfactorily. This in turn creates new problems in that larger membranes tends to distort, wobble and/or be prone to internal wave propagation, which are phenomena detrimental to the quality of the sound.

DESCRIPTION OF THE INVENTION

It is therefore an object of the present invention to provide a ring shaped membrane, which alleviates drawbacks of prior art ring dome constructions having a centrally arranged plug.

The present invention addresses this by providing a ring shaped membrane for an electro-acoustical loudspeaker, where said membrane comprises two or more dome-shaped annulus concentrically arranged around a central portion through which an imaginary axis of symmetry passes, where an outer periphery of said membrane is suitable to be attached to a surround; where the central portion is attached to a tower, which again is fastened to the loudspeaker's driver, wherein the angle between a plane being perpendicular to the axis of symmetry and the attachment of the membrane to the surround the surround resp. the tower is in the interval 0° to 40°, most preferred around 30°.

The plane as defined above is traditionally the plane in which the chassis of the loud-speaker construction will be placed. As the sound is generated by the membrane, the tower, to which the central portion of the membrane is fastened, does not interfere with the sound generation of the present invention. By furthermore fastening a central portion of the membrane to the tower, without having a plug interfering with the central portion just in front of the membrane, the sound is free to be emitted from the entire surface of the membrane. For steeper angles a problem of interference would arise but due to the shallow angels used within the present invention in the interval 0° to 40° the interference problems are avoided and at the same time a relatively large effective area radiating sound is provided. Traditionally it is desirable to provide as much membrane surface perpendicular to the direction into which it is desirable to radiate the sound but once the membrane becomes too flat undesirable effects will arise in the membrane such as for example wobbling, distortion, resonances and the like having a detrimental effect on the sound reproducing properties of such a membrane.

With the present invention, however, it has been found that by providing annular shaped ring segments concentrically arranged around a central axis of symmetry where the angles between the membrane material and the plane discussed above which is typically the plane where the membrane is fastened to the chassis, is in the interval 0° to 40°, a very advantageous construction is achieved in that a relatively large and effective membrane area is provided in relation to the prior art devices such that a higher efficiency may be achieved with a smaller area and thereby with a more compacted construction.

Tests have indicated that the membrane construction according to the present invention in relation to prior art devices has an efficiency which is 3 to 5 dB more than the traditional membranes. Furthermore, the sound distribution due to the lack of the plug in the centre portion of the membrane is greatly improved as compared to prior art devices.

In a further advantageous embodiment of the invention the voice coil is attached to the membrane and preferably the voice coil is attached in a point coinciding with the lowest point between the two innermost annular dome-shaped annulus. In this manner the voice coil is fastened to the strongest point of the membrane for transferral of the mechanical forces arising from the movement of the voice coil in the air gap as discussed above. It is therefore possible to transfer relatively large forces to the ring-shaped membrane's annuluses even at the shallow angles according to the invention, providing for the enlarged effective membrane area such that in addition to a better sound reproduction with no or negligible sound interference the effectiveness of the membrane as such is also greatly improved due to the voice coil arrangements in the relatively strong section of the membrane, where the forces may be evenly distributed to the two concentrically arranged dome-shaped annulus.

In a still further advantageous embodiment the central portion of the membrane is fastened to the tower by means of an adhesive. And in a still further advantageous embodiment, the tower is provided with a cavity, which cavity is at least partly filled with an adhesive, thereby connecting the central portion of the membrane to the tower. The adhesive may optionally retain elastic or resilient properties during its service life.

In this manner the fastening of the membrane to the tower is carried out such that no concentration of forces and thereby tension in the membrane is present. Furthermore, by having the adhesive provided with resilient or elastic properties, the adhesive as such is also an important member in dampening the moving membrane whereby any distortion or wobbling in the membrane, which could arise, will be dampened by the adhesive in the cavity. As furthermore, the adhesive is arranged on the backside of the membrane relative to the sound admitting surface, the adhesive as such will have no influence on the sound emitting properties of loudspeaker incorporating such a membrane, and thereby the membrane's characteristics as explained above will be maintained free of interference from the fastenings.

Furthermore, as set out in a further advantageous embodiment of the invention, designing the adhesive such that it has a certain viscosity and thereby pre-designing the mechanical dampening properties of the membrane the choice of adhesive may actually be chosen such that it is possible to adjust the mechanical dampening properties of the membrane by adjusting the viscosity of the adhesive. Typically adhesives containing long polymers are preferred, in that their elastic properties will remain even when exposed to extended mechanical action as is the case for loudspeakers of this type. The person skilled in the art will know how to modify the adhesives in a manner in order to obtain the desired viscosity.

In a manner exhibiting comparable advantages as stated above the membrane in a further advantageous embodiment is provided with a V-shaped portion along and immediate adjacent the outer periphery, which V-shaped portion is received in a reservoir either provided in the surround or in the chassis, which reservoir connects with the membrane by means of an adhesive.

In a further advantageous embodiment of the invention an alternative to fastening the membrane by means of an adhesive is an embodiment wherein the central portion of the membrane is fastened to the tower by means of fastening member, having a head portion and a stem, where said stem penetrates the membrane and is fastened to the tower, and where said head has a size maintaining the membrane in contact with said tower. The head portion of the fastening member shall be designed such that it does not interfere with the admission of sound which is to say that the head portion should be relatively shallow and not have a size substantially larger than the cross section of the tower in connection with the membrane.

The relatively shallow design of the membrane, in the direction in which the membrane extends along the axis of symmetry in combination with the dome-shaped annulus and central fastening, provides for a very stable construction such that the voice coil in the air gap does not exhibit much play, whereby the air gap may be optimised whereby thereby the magnetic field in the air gap is increased, whereby the membrane as such may be persistent to higher power output.

DESCRIPTION OF THE DRAWING

The invention will now be described with reference to the accompanying drawing wherein

Turning to FIG. 1, the membrane 1 comprises two dome-shaped annulus 2,3 arranged concentrically one inside the other. Along the outer most periphery, adjacent the outer dome-shaped annulus 3 is provided a flange 4 which is suitable in a traditional way to be fastened to a surround and thereafter to a loudspeaker chassis. Between the two concentrically arranged dome-shaped annulus 2,3 is a valley 5 defining the lowest point between the two innermost annual dome-shaped annulus 2,3. A voice coil cylinder 6 carrying a voice coil 7 is attached in this point. As the voice coil cylinder moves up and down in response to the direction change of the current in the voice coil, when arranged in a magnetic field, the forces will be distributed in the ring segments of the dome-shaped annulus 2, 3 without wasting energy in bending the membrane, but most of the energy will be used in moving the dome-shaped annulus back and forth thereby emitting sound.

Figures 1, 2:
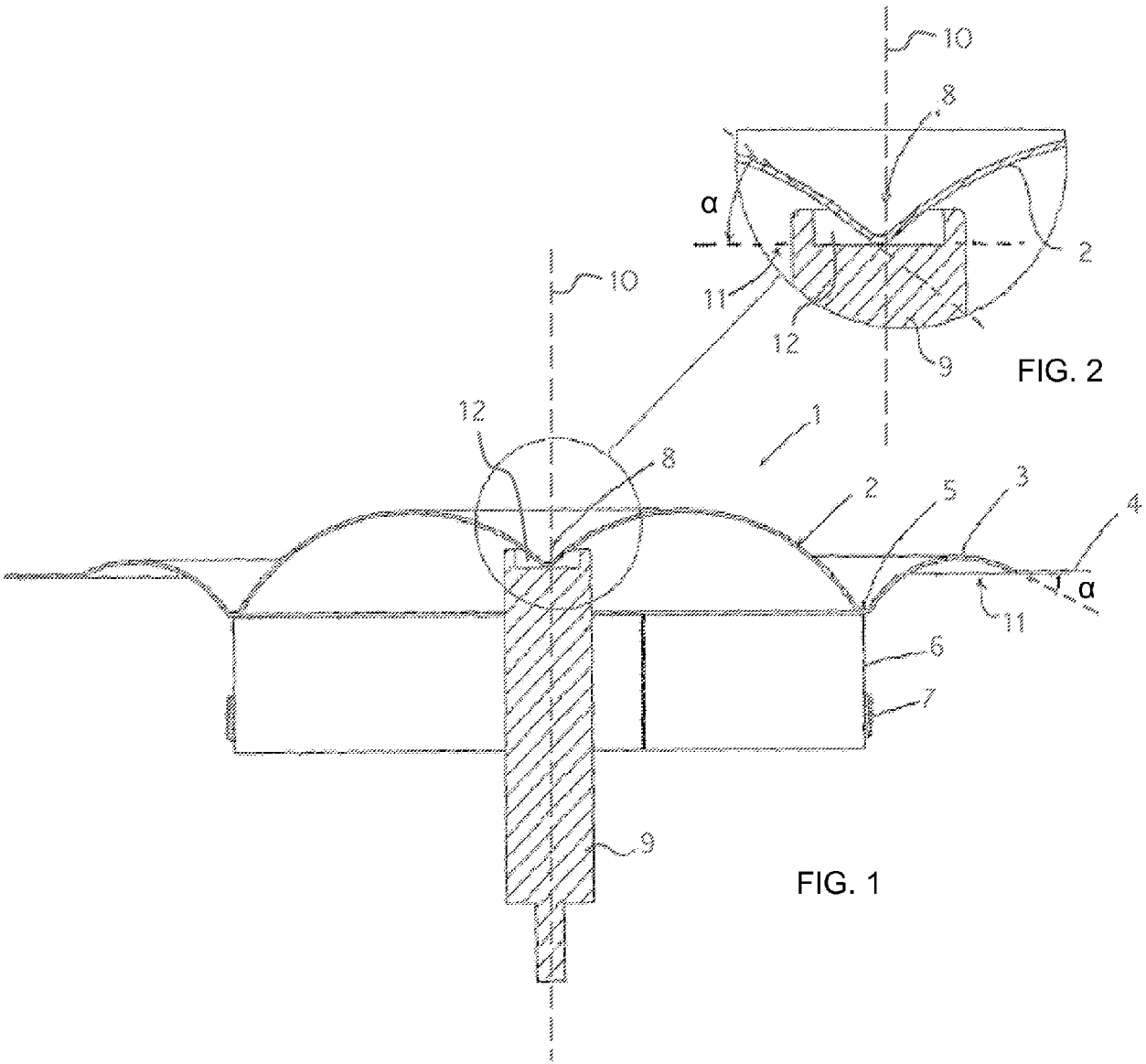
FIG. 1 illustrates a cross section of a membrane according to the invention and FIG. 2 illustrates a detailed view of the fastening of the membrane centrally to the tower.

Centrally, a central portion 8 of the membrane is fastened to a tower 9, which tower again is fastened to a loudspeaker driver construction (not illustrated). The fastening of the central portion 8 to the tower 9 will be explained with reference to FIG. 2 below.

The membrane 1 is symmetrical around an axis of symmetry 10 going through the central portion 8 of the membrane. An imaginary plane 11 arranged perpendicular to the imaginary axis of symmetry 10 will be referred to in order to explain the detailed properties of the membrane 1. Along the periphery i.e. inside the flange 4 the outermost dome-shaped annulus is arranged at an angle of no more than 40° in relation to the imaginary plane 11 as illustrated by the angle a.

Turning to FIG. 2 the detailed fastening arrangement of the central portion 8 to the tower 9 is illustrated. The angle a between the imaginary plane 11 and the inner dome-shaped annulus 2 is to be arranged in the interval including 0° to 40°. In the particular embodiment the angle a is approximately 30°, which has proven to be a desirable compromise in that the strength that the dome-shaped annulus in relation to the effective membrane area is relatively high, such that a very good efficiency with very low distortion is achieved.

The tower is furthermore in this embodiment provided with a cavity 12 which in order to fasten the membrane 2 to the tower 9 may be filled with an adhesive (not illustrated). The adhesive may be selected having an appropriate viscosity such that the adhesive will exhibit elastic or resilient properties which in turn will act as a dampener on the membrane therefore in addition to fastening the central portion 8 of the membrane to the top of the tower 9 the fastening will also exhibit dampening properties. The dampening properties will not interfere with the membrane's ability to emit sound and as such in contradiction to other ring shaped or dome shaped membranes implementing a plug with the construction with a cavity in the top of the tower not influence the effective membrane area significantly.

The invention claimed is:

1. A ring-shaped membrane for an electro-acoustical loudspeaker, where said membrane comprises two or more dome-shaped annulus concentrically arranged around a central portion of the membrane through which an imaginary axis of symmetry passes, where an outer periphery of said membrane is suitable to be attached to a surround;

wherein the central portion of the membrane is attached to a tower connected to the loudspeaker driver, and the angle between a plane being perpendicular to the axis of symmetry and the attachment of the membrane to the tower is in the interval 0° to 40°, and wherein a voice coil cylinder is attached to the membrane at an intersection of the outer dome shaped annulus and the inner dome shaped annulus.

2. The membrane for an electro-acoustical loudspeaker as set forth in claim 1 wherein the center point of the membrane is attached to the tower by an adhesive between the center point of the membrane and the tower.

3. The membrane for an electro-acoustical loudspeaker as set forth in claim 1 wherein a peak of the inner dome shaped annulus is positioned axially higher along the axis of symmetry than a peak of the outer dome shaped annulus.

4. The membrane for an electro-acoustical loudspeaker as set forth in claim 1 wherein the intersection of the outer dome shaped annulus and the inner dome shaped annulus is positioned at a lowermost axial position of the membrane along the axis of symmetry.

5. The membrane for an electro-acoustical loudspeaker as set forth in claim 1 wherein the inner and outer dome shaped annulus are both concave in the same axial direction along the axis of symmetry.

6. The membrane for an electro-acoustical loudspeaker as set forth in claim 1 wherein the tower is provided with a cavity in which the center point of the membrane is attached.

7. The membrane for an electro-acoustical loudspeaker as set forth in claim 6 wherein an adhesive is provided in the cavity to secure the center point of the membrane to the tower.

8. A membrane for an electro-acoustical loudspeaker comprising:

an outer dome shaped annulus and an inner dome shaped annulus concentrically arranged about a central portion of the membrane;

an outer periphery of the outer dome shaped annulus attached to a surround and the inner dome shaped annulus comprising the central portion of the membrane attached to a tower connected to a loudspeaker driver;

a front side sound emitting surface;

a back side surface; and wherein the back side surface at the center point of the membrane is attached to the tower so that sound is free to be emitted from substantially the entire front side sound emitting surface of the membrane; and wherein the central portion of the membrane is attached to the tower solely by an adhesive between the central portion of the membrane and the tower.

9. The membrane for an electro-acoustical loudspeaker as set forth in claim 8 wherein the central portion of the membrane is attached to the tower at an angle of about 30 degrees.

10. The membrane for an electro-acoustical loudspeaker as set forth in claim 8 wherein the membrane is defined extending substantially radially about an axis of symmetry passing through the central portion of the membrane.

11. The membrane for an electro-acoustical loudspeaker as set forth in claim 10 wherein a peak of the inner dome shaped annulus is positioned axially higher along the axis of symmetry than a peak of the outer dome shaped annulus.

12. The membrane for an electro-acoustical loudspeaker as set forth in claim 10 wherein the intersection of the outer dome shaped annulus and the inner dome shaped annulus is positioned at a lowermost axial position of the membrane along the axis of symmetry.

13. The membrane for an electro-acoustical loudspeaker as set forth in claim 10 wherein the inner and outer dome shaped annulus are both concave in the same axial direction along the axis of symmetry.

14. The membrane for an electro-acoustical loudspeaker as set forth in claim 8 wherein the tower is provided with a cavity in which the central portion of the membrane is attached.

15. The membrane for an electro-acoustical loudspeaker as set forth in claim 14 wherein an adhesive is provided in the cavity to secure the central portion of the membrane to the tower.

16. A method of fabricating an electro-acoustical loudspeaker comprising the steps of:

providing a membrane having a outer dome shaped annulus and an inner dome shaped annulus concentrically arranged about a central portion of the membrane;

attaching an outer periphery of the outer dome shaped annulus to a surround and attaching the inner dome shaped annulus comprising the central portion of the membrane to a tower fastened to a loudspeaker driver;

defining the membrane to have a front side sound emitting surface and a back side surface; and attaching the back side surface at the central portion of the membrane to the tower so that sound is free to be emitted from substantially the entire front side sound emitting surface of the membrane; and providing the tower with a cavity and providing an adhesive in the cavity to secure the central portion of the membrane to the tower.

* * * * *